US007815257B2

(12) United States Patent
Costaglia et al.

(10) Patent No.: US 7,815,257 B2
(45) Date of Patent: Oct. 19, 2010

(54) ADJUSTMENT DEVICE FOR ADJUSTABLE CHAIRS

(75) Inventors: Massimo Costaglia, Santa Giustina in Colle (IT); Alessandro Slongo, Mogliano Veneto (IT)

(73) Assignee: L & P Property Management Company, South Gate, CA (US)

( * ) Notice: Subject to any disclaimer, the term of this patent is extended or adjusted under 35 U.S.C. 154(b) by 92 days.

(21) Appl. No.: 12/098,142

(22) Filed: Apr. 4, 2008

(65) Prior Publication Data

US 2009/0008978 A1 Jan. 8, 2009

(30) Foreign Application Priority Data

Apr. 6, 2007 (IT) ..... MI2007A0718

(51) Int. Cl.
*A47C 1/024* (2006.01)

(52) U.S. Cl. ..... 297/303.5; 297/374

(58) Field of Classification Search ..... 297/354.12, 297/374, 301.5, 301.6, 301.7, 300.6, 300.7, 297/300.8, 302.5, 302.6, 302.7, 344.19, 303.1, 297/303.5, 303.4
See application file for complete search history.

(56) References Cited

U.S. PATENT DOCUMENTS 2,778,409 A * 1/1957 Soderberg ..... 297/301.3
3,711,054 A * 1/1973 Bauer ..... 248/562
4,348,898 A 9/1982 Stan
4,408,800 A 10/1983 Knapp
4,438,898 A 3/1984 Knoblauch
4,652,050 A 3/1987 Stevens
4,889,384 A 12/1989 Sulzer
5,029,940 A 7/1991 Golynsky
5,871,258 A 2/1999 Battey
5,997,087 A 12/1999 Stumpf
6,000,756 A 12/1999 Hybarger
6,010,189 A 1/2000 Hybarger
6,027,169 A 2/2000 Roslund, Jr.
6,378,943 B1 4/2002 Beggs
6,588,845 B2 7/2003 Wilkerson
6,685,267 B1 2/2004 Johnson et al.
6,712,428 B2 * 3/2004 Moreschi ..... 297/303.4
6,779,847 B2 8/2004 Klein
6,871,909 B2 3/2005 Hobb
6,921,134 B1 7/2005 Hong
6,945,603 B2 9/2005 Elzenbeck
6,957,862 B2 10/2005 Chen (Continued)

FOREIGN PATENT DOCUMENTS

EP 0105955 B1 2/1986

(Continued)

*Primary Examiner*—Milton Nelson, Jr.
(74) *Attorney, Agent, or Firm*—Shook, Hardy & Bacon L.L.P.

(57) ABSTRACT

Adjustment device for chairs, comprising a back support capable of rotating around a shaft fastened to a support base, said support for the backrest being provided with a blocking plate having a plurality of openings, an insert capable of limited movement in a defined track in the support base to engage and disengage said openings, and an actuator connected to said insert, in which the actuator is operated by a rod connected to a handle that can be operated by the user, said actuator being movable between a release position and a lock position, in which said insert is selectively engaged in one of said openings.

10 Claims, 10 Drawing Sheets

U.S. PATENT DOCUMENTS

| | | | | |
|---|---|---|---|---|
| 6,957,864 | B2 | 10/2005 | Chen | |
| 7,014,262 | B2 * | 3/2006 | Rossetto et al. | 297/300.8 |
| 7,040,711 | B2 | 5/2006 | DeKraker | |
| 7,147,285 | B2 | 12/2006 | Lin | |
| 2001/0013569 | A1 | 8/2001 | Donati | |
| 2004/0140703 | A1 | 7/2004 | Bock | |
| 2004/0212235 | A1 | 10/2004 | Elzenbeck | |
| 2004/0245827 | A1 | 12/2004 | Bedford et al. | |
| 2006/0071522 | A1 | 4/2006 | Bedford et al. | |
| 2006/0163925 | A1 | 7/2006 | Bock | |
| 2006/0255636 | A1 | 11/2006 | Donati | |
| 2006/0290185 | A1 | 12/2006 | Moreschi | |
| 2007/0040432 | A1 | 2/2007 | Donati | |
| 2007/0040433 | A1 | 2/2007 | Huang | |

FOREIGN PATENT DOCUMENTS

| | | | |
|---|---|---|---|
| EP | 0568233 | B1 | 6/1996 |

* cited by examiner

ADJUSTMENT DEVICE FOR ADJUSTABLE CHAIRS

CROSS-REFERENCE TO RELATED APPLICATIONS

This application claims priority to prior-filed Italy application Serial No. MI2007A 000718, filed Apr. 6, 2007, incorporated by reference herein.

BACKGROUND OF THE INVENTION

The present invention relates to a control device for adjustable chairs and the like. More particularly, the invention relates to a control device that makes it possible to adjust the reaction force of the backrest when the user leans against it, the position of the backrest, the tilt of the backrest with respect to the seat surface, and adjusting the gas lever that adjusts the tensions of the backrest.

As is known, office chairs, for example, are provided with adjustment devices, both for the tilt of the backrest and for the reaction force which the backrest can exert when the user leans against it, adjusting the gas-operated activation lever of the backrest tension.

The devices of the known type are typically rather complicated in terms of the number of components and therefore susceptible to breaking down and also involve maintenance issues in that repairs are costly and complicated.

In particular, generally, the adjustment mechanisms for backrest tilt with respect to the seat have a rear support which revolves on the shaft fastened to the support base. Normally, a blocking head is fastened to the rear support by welding or other mounting systems. This blocking head has a plurality of openings and a movable insert and has the possibility of sliding on the appropriate track and has the function of engaging, or not engaging, the openings. If the insert is positioned within an opening, the mechanism is in the blocked position. If the insert is positioned outside of the openings, the mechanism is in the released position. Such a blocking system is typically operated by rotating a lever.

As stated above, the movement of the insert that makes it possible to engage in the openings is produced, in devices of the known type, using a number of components making the mechanism complicated, and this situation is also reflected in the adjustment of the tension of the backrest, that is its reaction to the weight of the user who rests against it.

SUMMARY OF THE INVENTION

In one embodiment of the present invention, a control device for chairs having compact dimensions and which houses in it all of the possible adjustments for the chair to which it is applied, is provided.

This task, as well as these and other goals which will be better specified below, are achieved by a control device for chairs, comprising a back support designed to rotate around a shaft fastened to a support base, said backrest support being provided with a blocking plate provided with a plurality of openings, a movable insert for engaging and disengaging said opening, characterized in that said insert is provided with means limiting the travel of the insert designed to slide in a defined track in the support base, an actuator being provided, operated by a rod connected to a handle that can be operated by the user, said actuator being movable from a release position to a lock position and vice-versa, in which said insert selectively engaged in one of said opening, said actuator being connected to said insert.

BRIEF DESCRIPTION OF THE DRAWING

Further characteristics and advantages of the invention will be found in the specification of one or more embodiments of the device according to the invention, illustrated by way of non-limiting examples of the attached drawings, in which.

DETAILED DESCRIPTION OF THE INVENTION

Figure 1:
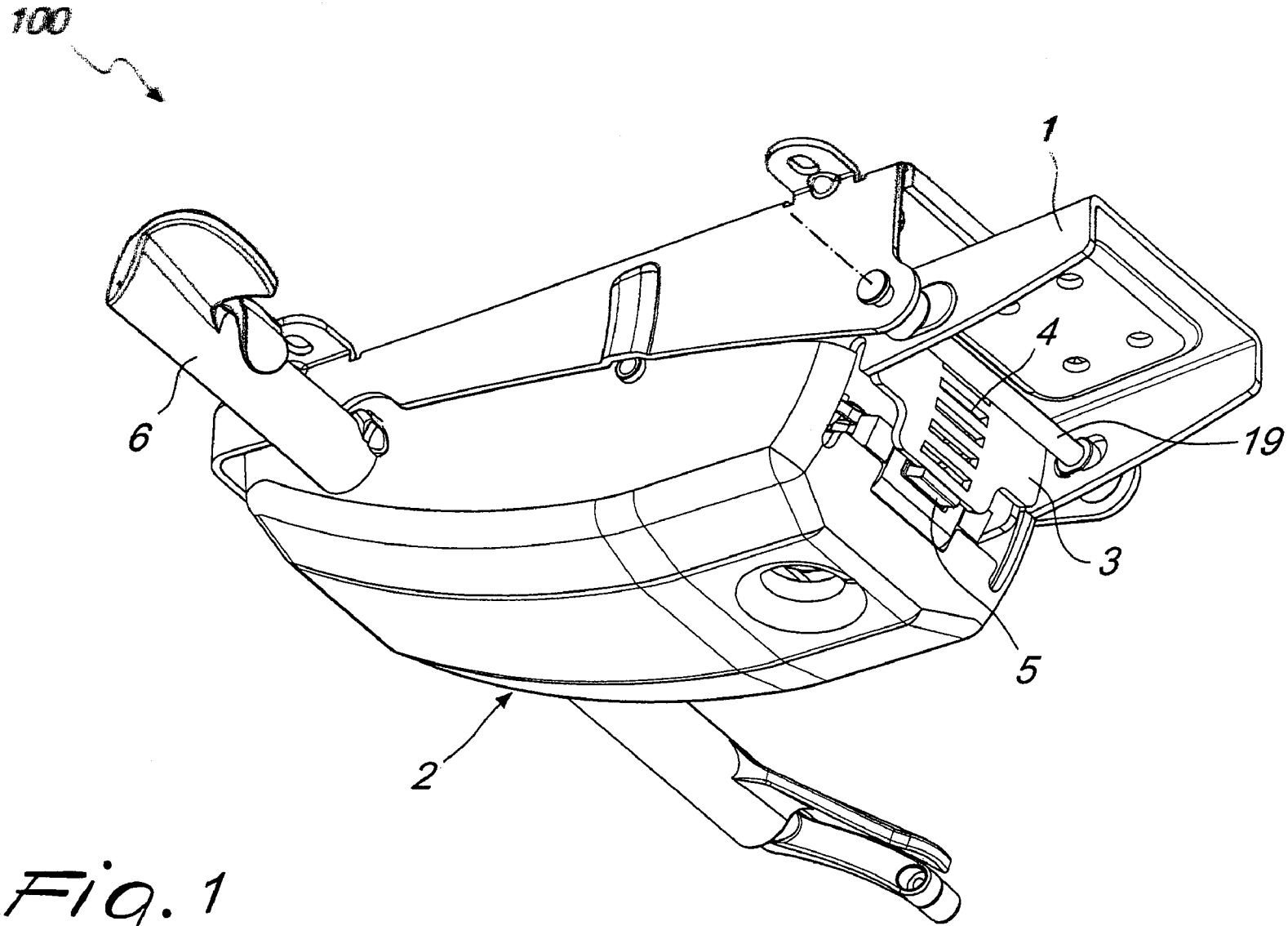
FIG. 1 illustrates a perspective view of the device according to the invention.

With reference to the Figures quoted above, the control device according to the invention, universally indicated by the reference number 100, comprises a support for the backrest 1, capable of rotating around a shaft fastened to a support base 2. A blocking plate 3 is fastened to the support 1 for the backrest through welding or other mounting systems. The blocking plate 3 has a plurality of openings or opening 4 in which a movable insert 5 is engageable which has the possibility of sliding on a suitable track to selectively engage the openings 4. If the insert 5 is positioned inside the opening 4, the mechanism is in the locked position, vice-versa, if the insert 5 is disengaged from the opening 4, the mechanism is in the released position.

Figure 2:
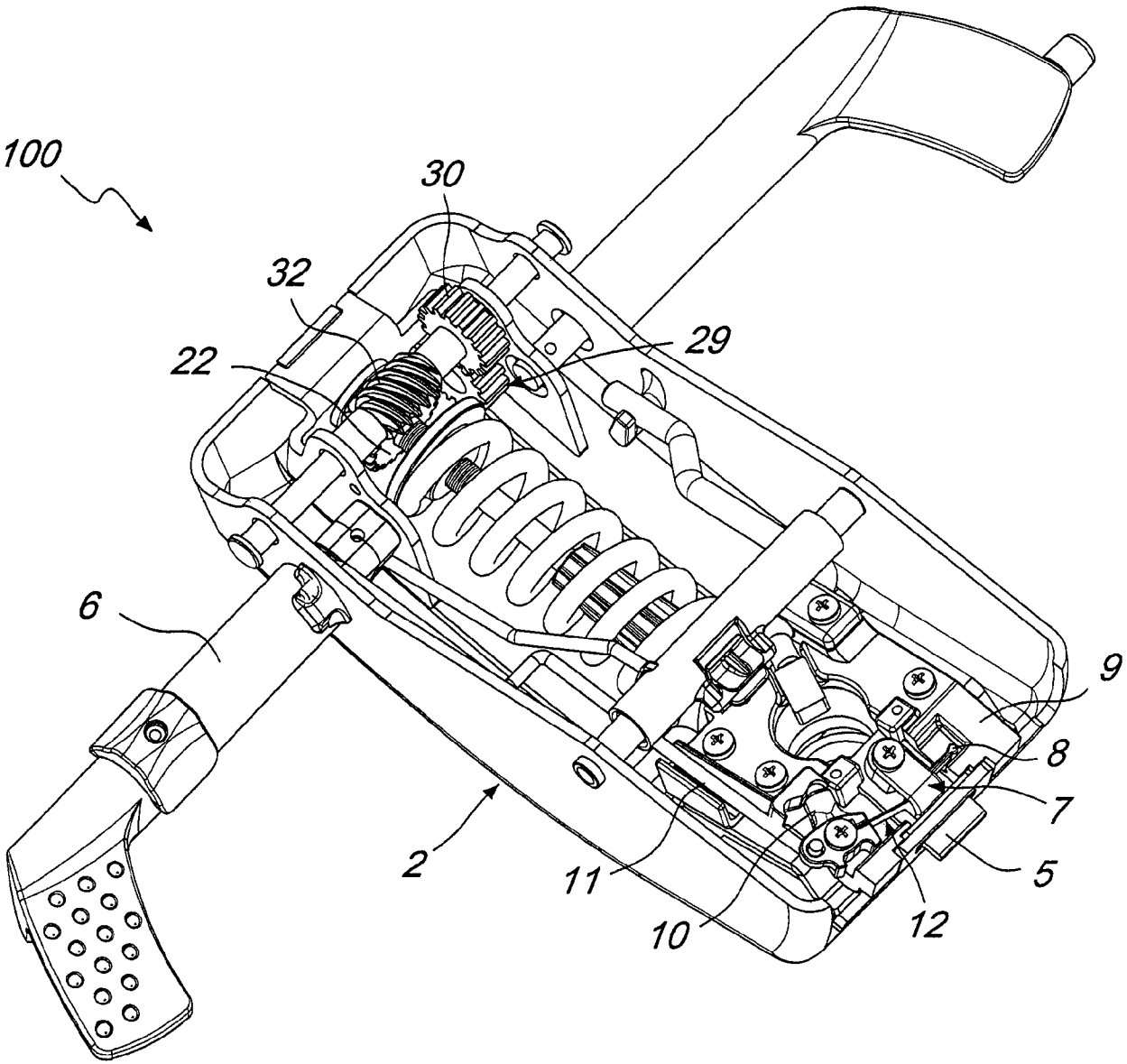
FIG. 2 illustrates in a partial sectional view a detail of the device according to the invention.
Figure 3:
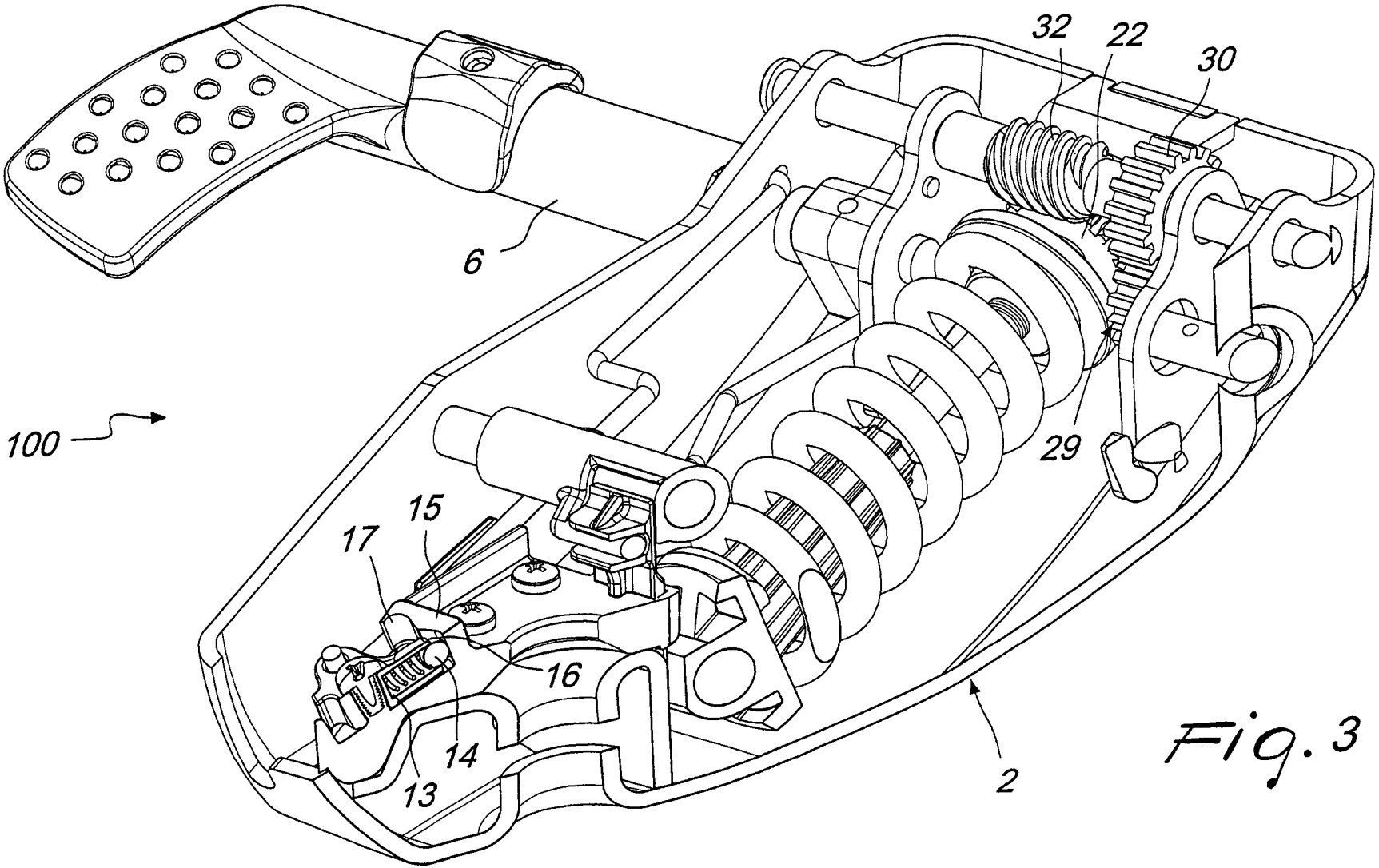
FIG. 3 illustrates a partial, sectional perspective view of a detail of the device according to the invention.

The blocking system is operated by rotating a lever 6. According to one feature, the blocking device, that is the movement of the insert 5 to engage it inside the openings 4, is produced according to the illustrations contained in FIG. 2 and FIG. 3.

In particular, means limiting the travel of the insert 5 are provided in the form, for example, of a plastic cover 7 integrated with the flexible tab 8 which has the function of limiting the movement of the insert 5, thus reducing noise due to the flexibility of the tab. The insert 5 slides along a track defined in a support 9. An actuator 10 rotates around a shaft integrated in the support 9. The rotating movement of the actuator 10 is produced by a rod 11 which is pulled by the handle or lever 6. A leaf spring 12 is fastened to the actuator 10. The opposite end of the leaf spring 12, relative to the end which is connected to actuator 10, engages with the cover 7 and when the actuator 10 rotates it also moves the leaf spring 12, relative to the end which is connected to actuator 10, engages with the cover 7 and when the actuator 10 rotates it also moves the leaf spring 12 which therefore thrusts the plastic cover 7.

The actuator 10 contains a protrusion with a cavity in which a compression spring 13 and a ball 14 (see FIG. 3) are located. Compression spring 13 thrusts the ball 14 against a partition 15 which is integrated on the support 9. The partition 15 has a particular profile with two pockets or seats 16 and 17. The function of the seats 16 and 17 is to determine two different and precise positions of the actuator 10. This combination of elements guarantees the bi-stability of the system, that is the two lock or release conditions.

When the actuator 10 rotates through the action of the lever 6, the leaf spring 12 thrusts the plastic cover 7, which is fastened to the insert 5. When the actuator is moved to the lock position, there is the positioning of the ball 14 within the seat 16, therefore ensuring the stability of the actuator.

The insert 5 is perfectly aligned with the opening 4, it enters immediately into the opening. If it is not properly aligned due to its positioning relative to the support 1, the insert 5 cannot engage in the opening. In this case, the leaf spring 12 deforms and applies a force against the plastic cover 5. This force is directed against the blocking plate 3. Due to this force, as soon as alignment occurs between the insert and an opening 4, the insert 5 enters into the opening 4 producing the blocked position. This behavior represents an "automatic search" for the blocked position because the user rotates the handle or grip 6 in blocking position and the device automatically provides the blocked position as soon as there is the correct alignment condition. The user can release the handle or grip 6 immediately after having rotated it.

Figure 4A:
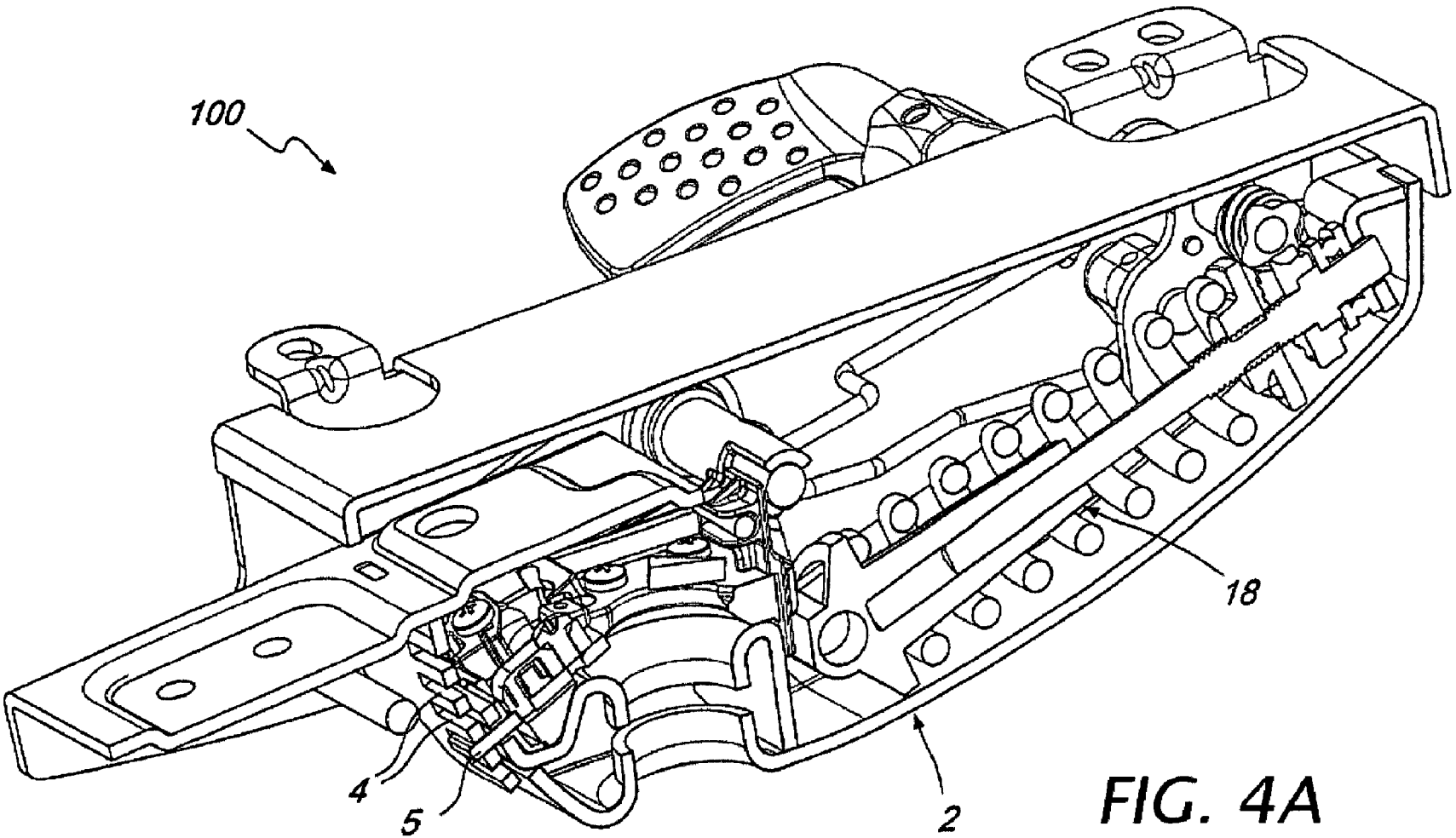
FIG. 4A illustrates a perspective view of the first operating condition of the device according to the invention.
Figure 4B:
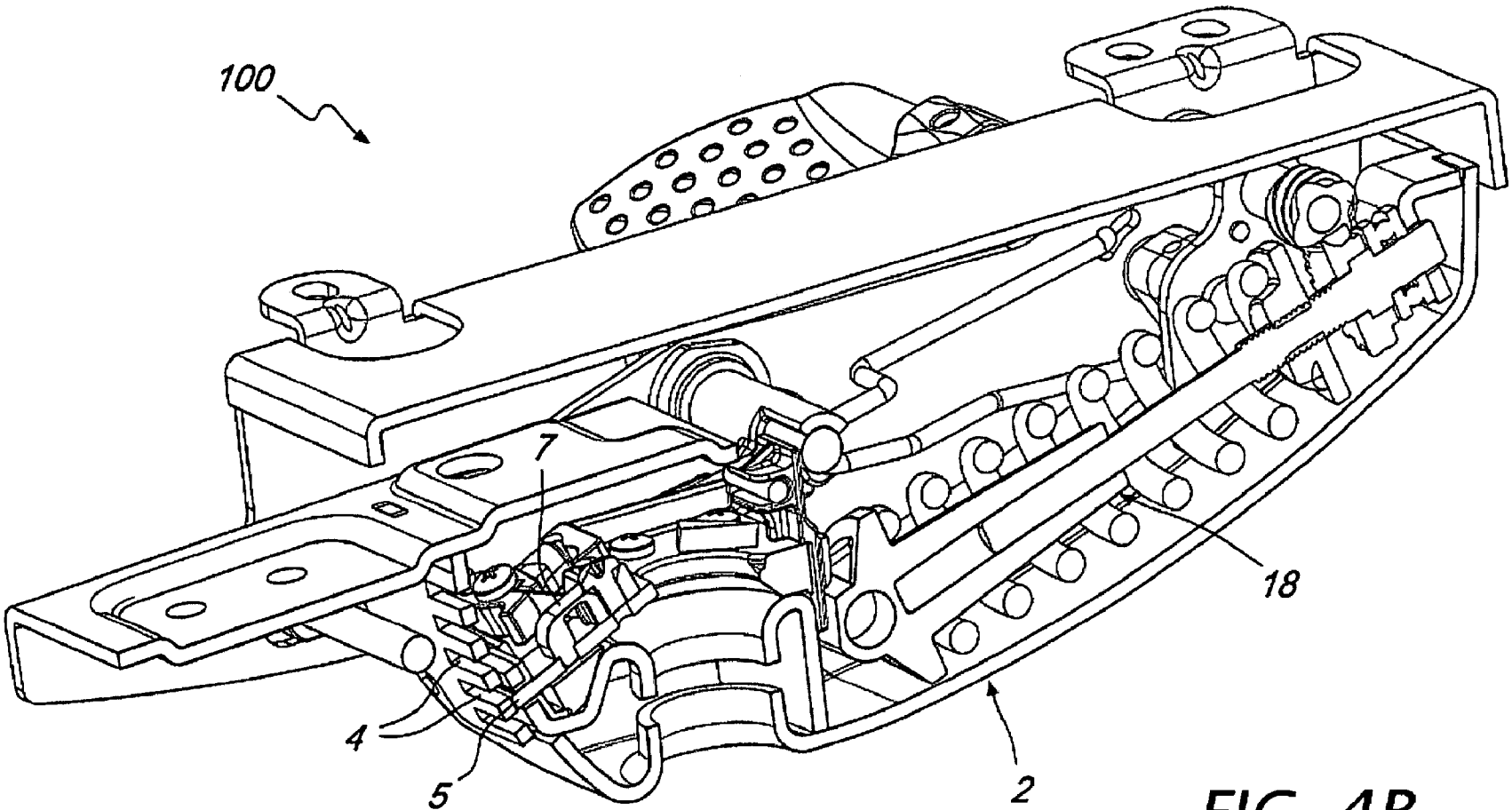
FIG. 4B illustrates a partial, sectional perspective view of the second operating condition of the device according to the invention.

FIGS. 4A and 4B illustrate the unaligned condition, that is of the released mechanism and the aligned condition, that is of a blocked mechanism, respectively.

When the mechanism is in a blocked condition, as in FIG. 4B, and the user rotates the lever or handle 6 to release the mechanism, it is necessary to provide a device that avoids the violent return of the backrest of the chair. This is because the impact of the backrest of the chair against the user can be dangerous. One of the advantages of the system described above is that the same components that produce the automatic search for the blocked position as explained above are the same and also guarantee a shock-absorbing function.

Accordingly, when the actuator 10 is rotated to release the mechanism, one finds that the ball 14 passes into the seat 17, from the seat 16, and maintains the actuator 10 in a stable state, due also to the compression spring 13 which is compressed against the ball 14.

The device according to the invention, in one aspect, provides a mainspring 18, provided longitudinally inside the device, and capable of determining a force between the contact surfaces of the insert 5 and the opening 4 of the blocking plate 3. This force determines the impossibility of the return of the insert 5.

In this condition, the leaf spring 12 deforms and applies a force to the insert 5 which tends to restore the released condition. The force produced by the leaf spring 12 is weaker relative to the force of the mainspring 18. For this reason there is no disengagement of the insert 5 until the user applies pressure by leaning against the back of the backrest and tilting therefore backwards the backrest of the chair.

When the movement of the backrest occurs, the system automatically restores the released condition without violent impact. What has been described is the shock-absorbing function provided by the device.

Figure 5:
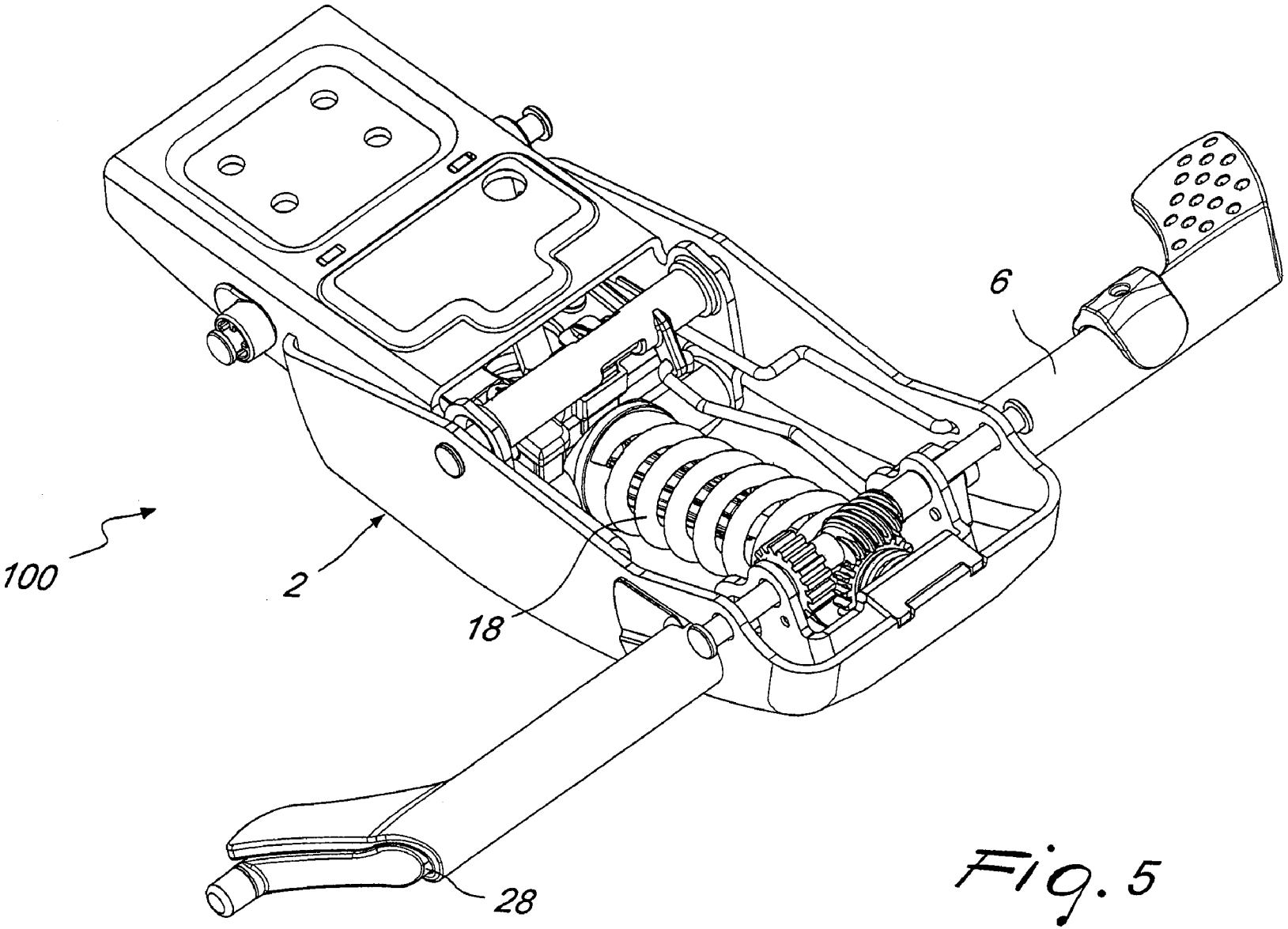
FIG. 5 illustrates a perspective view of the device according to the invention, as regards the characteristic of adjusting the tension of the backrest.
Figure 6:
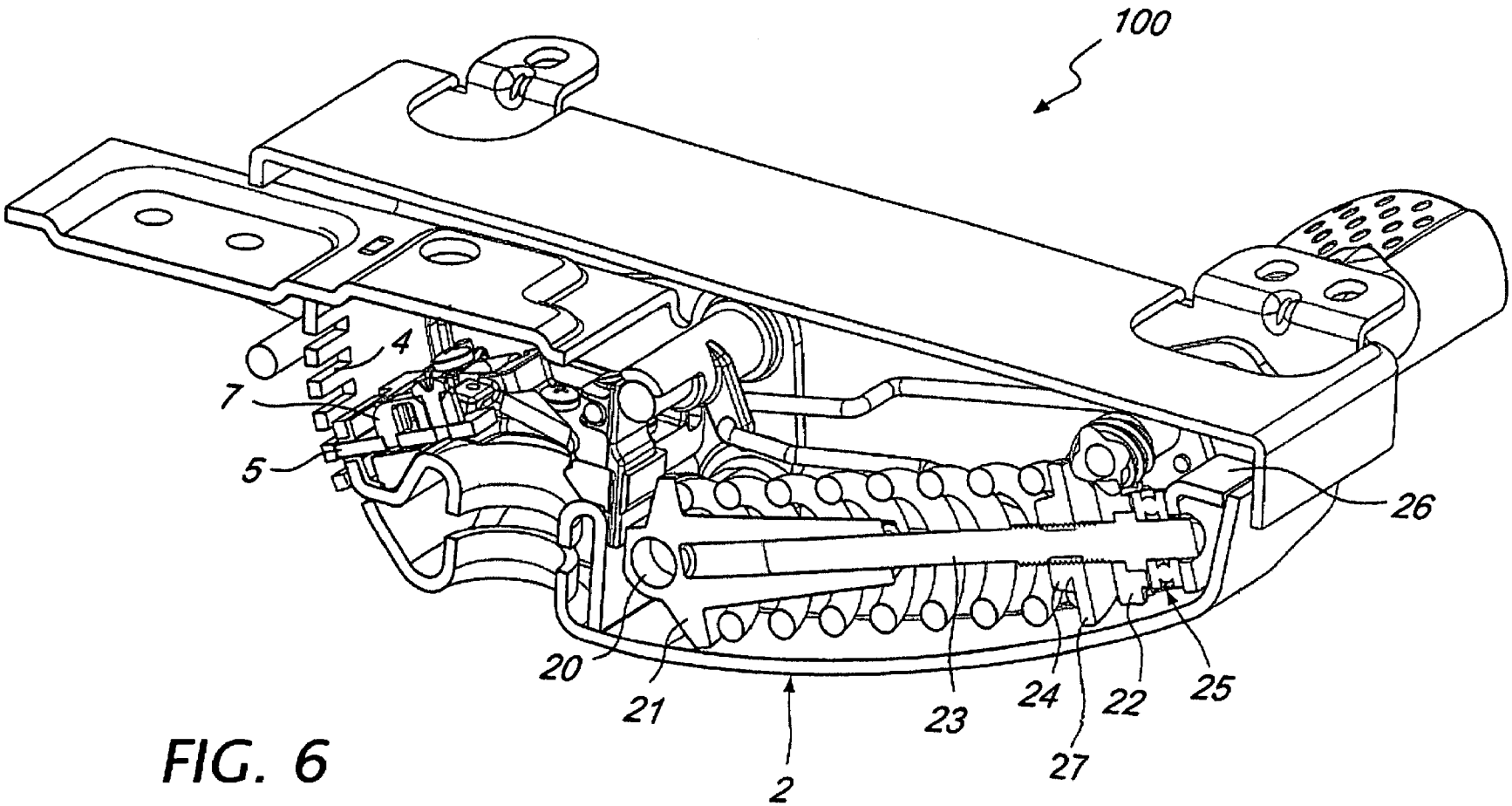
FIG. 6 illustrates a partial section perspective view of the device according to the invention.
Figure 7:
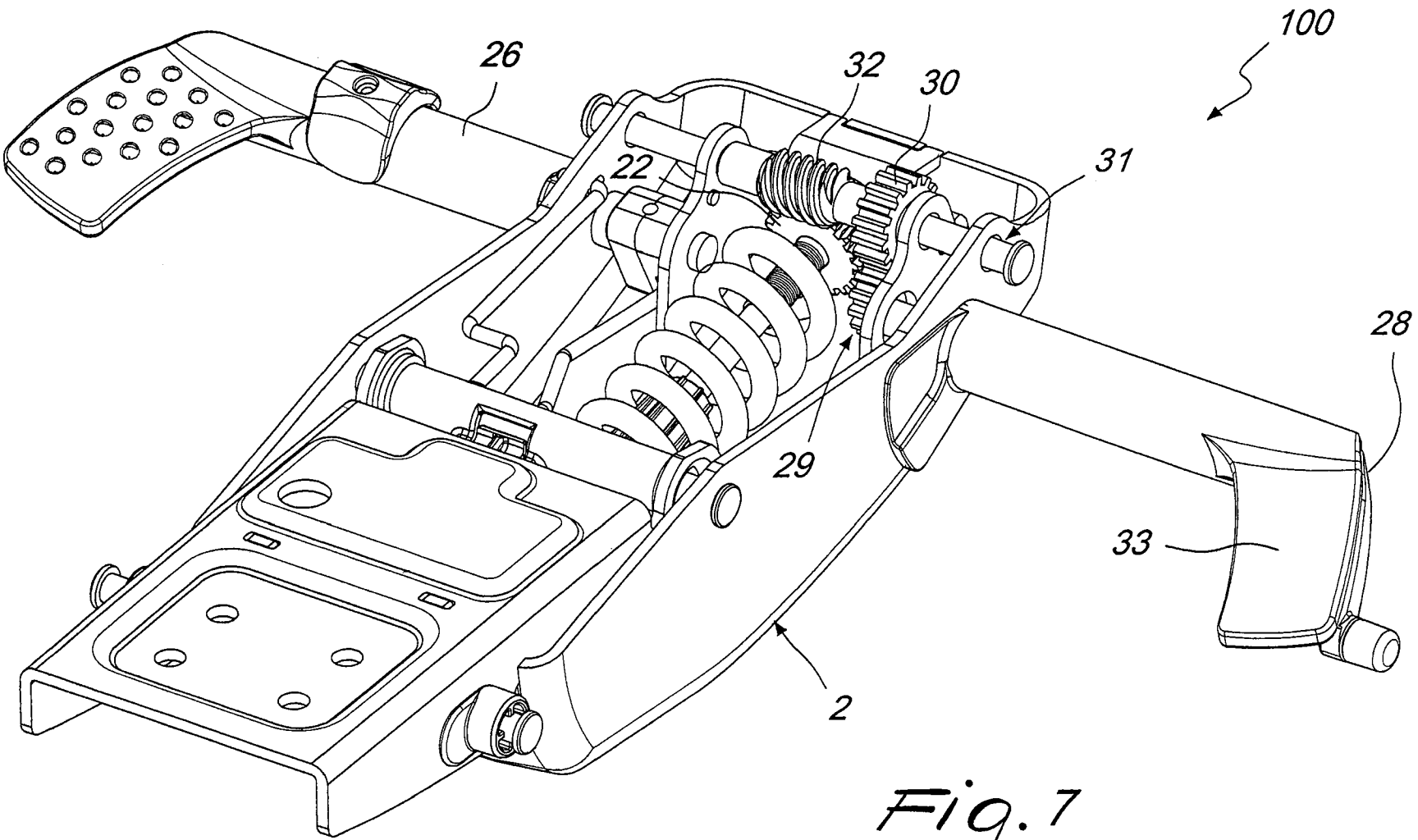
FIG. 7 illustrates a perspective view of the device according to the invention.
Figure 8:
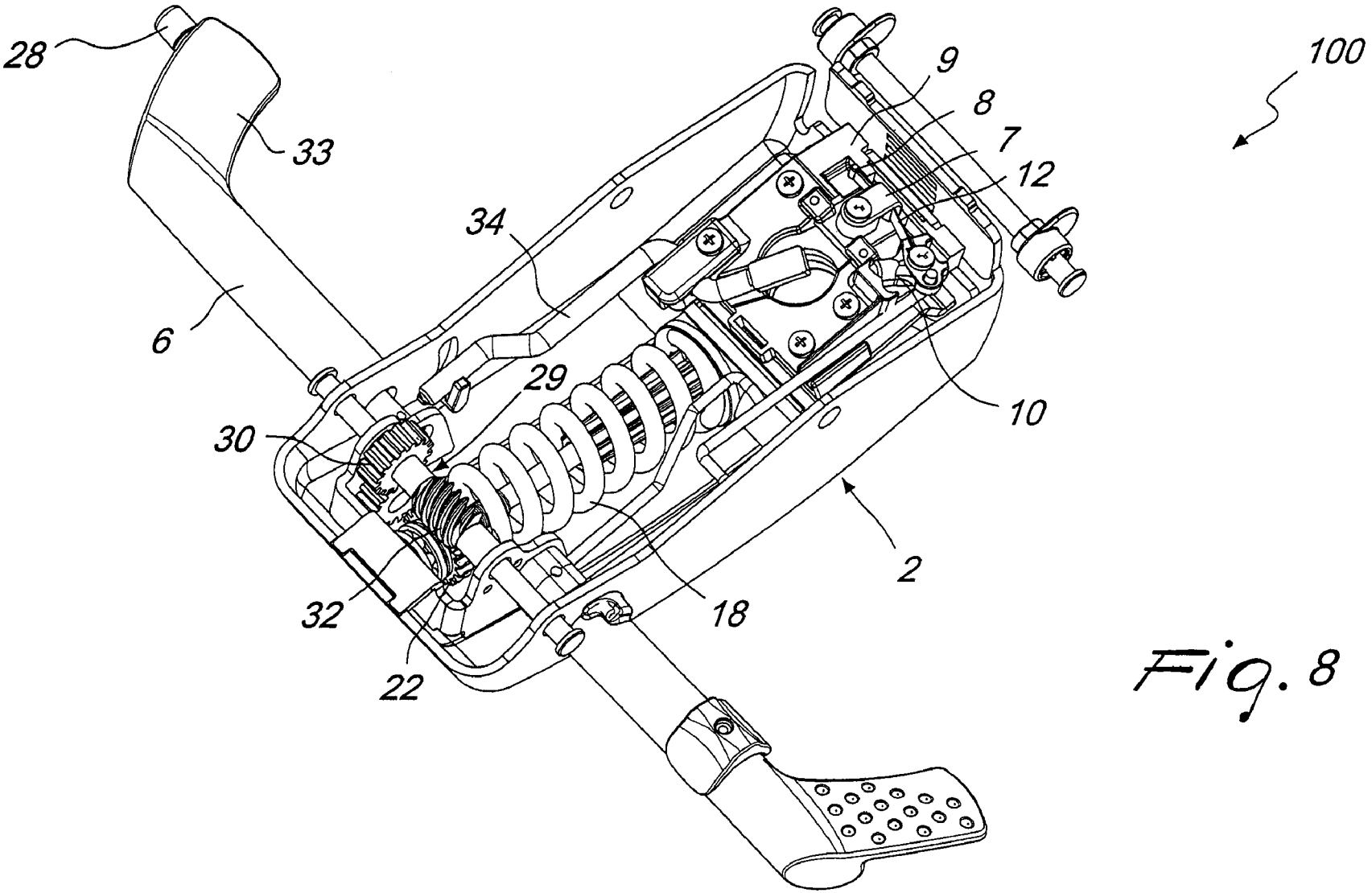
FIG. 8 illustrates a partial perspective view of the device according to the invention.
Figure 9:
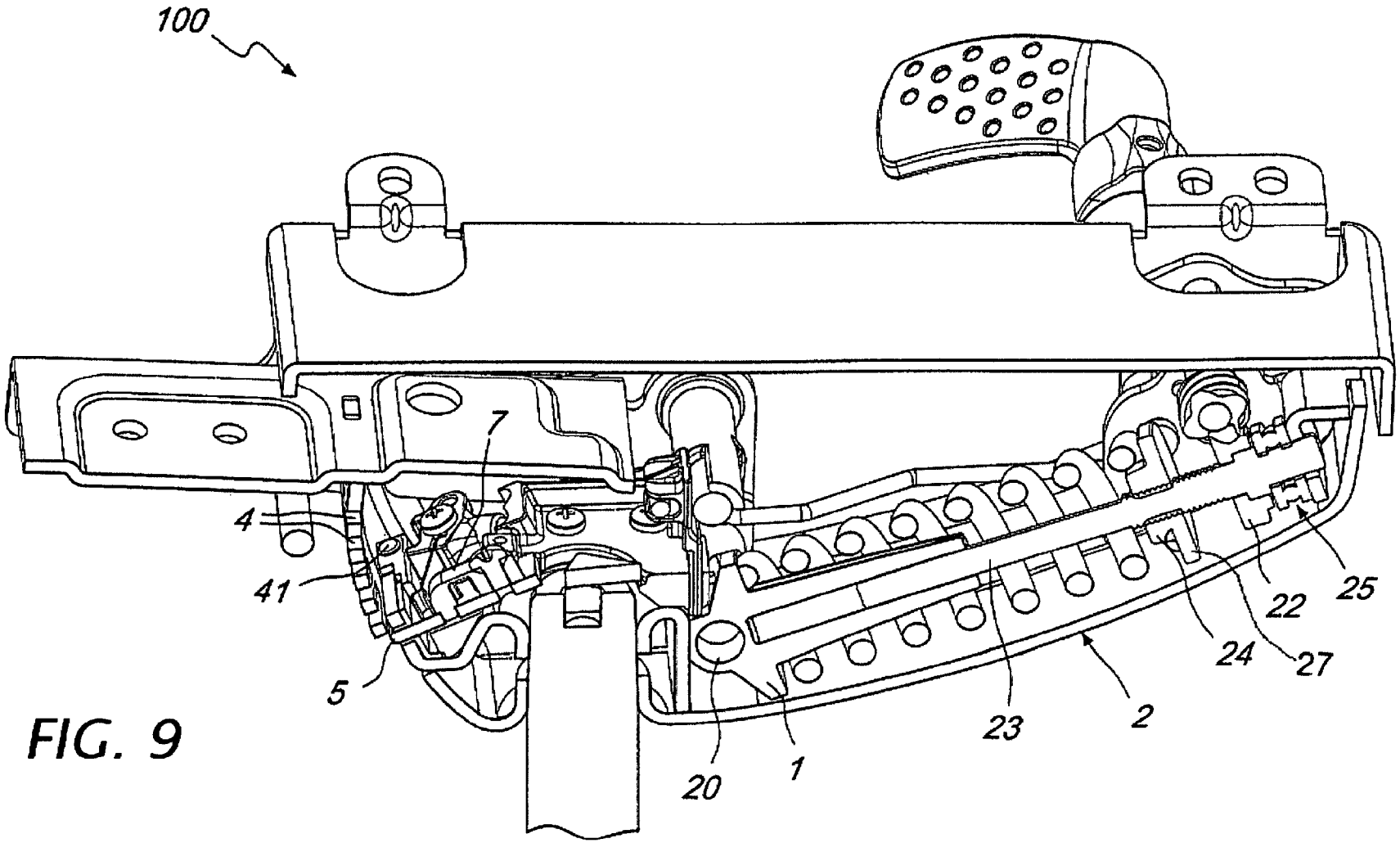
FIG. 9 illustrates a perspective view of the control device according to the invention, from below.

The device according to the invention, in one aspect, illustrated in FIGS. 5-7 also contains the special feature of having the possibility of adjusting the tension with which the backrest reacts to the force which the user applies by leaning against the backrest.

In particular, the support 1 revolves around a shaft 19 which is fastened to the support base 2, crosswise with respect to the position of the mainspring 18. The spring 18 is supported by a spring support 21, which is pivoted around a shaft 20 which in turn is fastened to the support 1. The support 21 of the spring 18 is guided along a rod 23, which is connected to the gear 22 and can therefore rotate with the gear.

The rod 23 has a threaded portion on which a hexagonal nut 24 acts. The rod 23 also has a shoulder which functions on a bearing 25. The bearing 25 is positioned between the shoulder of the rod 23 to a block 26 that houses the rod 23. The function of the bearing 25 is to reduce wear during adjustment.

The hexagonal nut 24 has a seat on a disk 27 such that the elements rotate together. The rotation of the rod 23 specifies the axial movement of the disk 27 which compresses mainspring 18 within which is inserted the rod 23. In this way, the force on the backrest of the chair can be adjusted according to personal preference.

The methods by which the rod 23 is rotated are best understood with reference to FIG. 7.

The grip 28, which protrudes radically from the support 2 can be activated by the user to adjust the tension. The grip 28 is fastened together with a gear 29. The gear 29 is connected to a second gear 30 which engages with it. The second gear 30 rotates around a shaft 31 which is arranged orthogonally relative to the development of the spring 18 and moves a worm screw 32. The worm screw 31 engages with the gear 22. The final rotation of the gear 22 produces the compression of mainspring 18. The above has the advantage of reducing the effort on the grip 28 and by changing the ratio between the gear 29 and the second gear 30 it is possible to customize the number of rotations of the grip or handle 28 or the range of tension adjustment.

The device according to the invention, in one aspect, also provides for an adjustment for gas-operated elements, as for example the height of the seat. In this case the activation occurs through a grip 33 which is positioned adjacent to the grip 28, and which, initiated by the user, moves a bar 34 housed inside the support 2, which rotates around a specific reference obtained on the support 9. One end of the bar 34 directly activates a gas valve.

Additionally, the device according to the invention, in one aspect, provides for the possibility that the support 9 functions as a rear stop for the moving of the support 1 of the backrest. A protuberance 41 integrated on the support 9 represents the contact area with support 1 when the mechanism is completely tilted backwards.

It has been found in practice how the control device according to the invention fully fulfils the task as well as the planned purposes, in that it allows the creation of a device that combines in a single support body or base 2, the function of adjusting the tension of the backrest, the blocking function of the tilt backrest, activating by gas of control device elements, and stop elements for the support 1.

The thus conceived device is subject to many modifications and variants, all of which fall within the scope of the inventive concept; also all of the details can be replaced by other technically equivalent elements.

In practice, the materials used, as well as the dimensions and contingent shapes can be any ones according to needs and the state of the art.

What is claimed is:

1. An adjustment device for a chair having a backrest and a seat, the adjustment device comprising a backrest support for supporting the backrest, wherein the backrest support is capable of rotating around a shaft fastened to a support base, said support for the backrest being provided with a blocking plate provided with a plurality of openings, an insert being movable for engaging and disengaging said openings, characterized in that said insert is provided with means limiting the travel of the insert, wherein the insert is capable of sliding in a defined track in an internal support within the support base, an actuator being provided, wherein the actuator is operated by a rod connected to a handle that can be operated by a user, said actuator being movable between a release position and a lock position, wherein in the lock position, said insert is selectively engaged in one of said openings, said actuator being connected to said insert.

2. A device according to claim 1, characterized in that said means limiting the travel of the insert include a cover fastened to said insert and provided with a flexible tab.

3. A device according to claim 2, characterized in that elastic means are connected at one end, to said actuator and, at an opposite end, to said cover fastened to said insert.

4. A device according to claim 1, characterized in that said actuator is provided with elastic means culminating in a ball capable of being engaged in a pair of seats capable of housing said ball to define the lock position and the release position respectively.

5. A device according to claim 1, comprising principal elastic means capable of allowing a tilting of the backrest relative to the chair seat, said principal elastic means being capable of acting on the internal support.

6. An adjustment device for a chair having a backrest and a seat, the adjustment device comprising:

a backrest support for supporting the backrest, wherein the backrest support is capable of rotating around a shaft fastened to a support base, said backrest support being provided with a blocking plate provided with a plurality of openings;

an insert being movable for engaging and disengaging said openings, characterized in that said insert is provided with means limiting the travel of the insert, wherein the insert is capable of sliding in a defined track in an internal support within the support base;

an actuator being provided, wherein the actuator is operated by a first rod connected to a handle that can be operated by a user, said actuator being movable between a release position and a lock position, wherein in the lock position, said insert is selectively engaged in one of said openings, said actuator being connected to said insert; and means capable of adjusting a tension of the backrest, said means comprising a support, elastic means, and a second rod, said support capable of housing said elastic means and said second rod disposed within said elastic means, said second rod being movable within said support, a nut being screwed on said second rod and capable of compressing said elastic means, said second rod being fastened to a block inside said support, said second rod being operable in rotation by a lever that can be operated by said user.

7. A device according to claim 6, including a gear connected to said second rod and rotatable by a worm screw placed in rotation by a first gear and a second gear operated by said lever.

8. A device according to claim 7, characterized in that said lever operates said first gear and said second gear meshes with said first gear.

9. An adjustment device for a chair having a backrest and a seat, the adjustment device comprising:

a blocking mechanism of the backrest of said chair in a given angle, a mechanism for adjusting a tension of said backrest, a mechanism for adjusting a rotational travel of said backrest, and a gas activation mechanism of an element of said chair, wherein said blocking mechanism comprises:

a backrest support for supporting the backrest, wherein the backrest support is capable of rotating around a shaft fastened to a support base;

a blocking plate having a plurality of openings;

an insert that is slidable in a defined track in an internal support disposed within the support base for engaging and disengaging said plurality of openings;

means for limiting the travel of the insert; and an actuator connected to the insert, wherein the actuator is operated by a rod connected to a handle that can be operated by a user, said actuator being movable between a release position and a lock position, wherein in the lock position, said insert is selectively engaged in one of said openings.

10. An adjustment device for a chair having a backrest and a seat, the adjustment device comprising:

a support base;

a bar disposed within the support base, wherein the bar is capable of rotating and is operated by a lever external to said support base, said bar activating a gas valve to move an element of said chair;

a backrest support for supporting the backrest, wherein the backrest support is capable of rotating around a shaft fastened to the support base;

a blocking plate having a plurality of openings;

an insert that is slidable in a defined track in an internal support disposed within the support base for engaging and disengaging said plurality of openings;

means for limiting the travel of the insert; and an actuator connected to the insert, wherein the actuator is operated by a rod connected to a handle that can be operated by a user, said actuator being movable between a release position and a lock position, wherein in the lock position, said insert is selectively engaged in one of said openings.

* * * * *